US005554059A

United States Patent [19]

Yamasaki

[11] Patent Number: 5,554,059

[45] Date of Patent: Sep. 10, 1996

[54] METHOD OF DAMPING VIBRATIONS OF HULL OF SMALL WATERCRAFT

[76] Inventor: Ichiro Yamasaki, 3, Ebisujima-cho 5-cho, Sakai-shi, Osaka, Japan

[21] Appl. No.: 381,320

[22] Filed: Jan. 31, 1995

[30] Foreign Application Priority Data

Feb. 1, 1994 [JP] Japan ..... 6-010465

[51] Int. Cl.[6] ..... B63H 1/15

[52] U.S. Cl. ..... 440/52; 248/638; 180/300

[58] Field of Search ..... 440/52, 111; 248/638; 180/300

[56] References Cited

U.S. PATENT DOCUMENTS 1,637,604 8/1927 Clark ..... 180/300

5,205,374 4/1993 Love et al. ..... 248/638

FOREIGN PATENT DOCUMENTS 8911416 11/1989 WIPO ..... 440/111

*Primary Examiner*—Jesus D. Sotelo

*Attorney, Agent, or Firm*—Wenderoth, Lind & Ponack

[57] ABSTRACT

An arrangement for damping vibrations transmitted from an engine of a small watercraft to its hull even while the ship is travelling at high speed. Its main engine is mounted on the bed of the ship by fixing its legs to the bed through a fixing element including rubber mounting members. This arrangement further includes an engine movement restricting member for preventing the engine from moving relative to the hull.

8 Claims, 6 Drawing Sheets

METHOD OF DAMPING VIBRATIONS OF HULL OF SMALL WATERCRAFT

BACKGROUND OF THE INVENTION

This invention relates to a method of damping vibrations transmitted from an engine of a small watercraft to its hull.

In the case of small watercraft such as motorboats and fishing boats, it was of secondary importance to damp engine vibration because the travel time and distance of such boats are usually far shorter than large ships. Thus, many older small ships have their engine mounted directly on an iron bed provided on the bottom of the hull. It is a recent trend, however, to mount the engine on an iron bed not directly, but through a rubber mount.

Such a rubber mount is a mounting member for supporting mounting legs provided parallelly on the engine. It includes a fixing member fixed to the bed, a rubber member inserted in the fixing member, and a mounting means comprising a bolt extending through the rubber member and a nut for fixing the bolt to the mounting leg of the engine by tightening it. The rubber member serves to absorb any vibration of the leg in vertical and horizontal directions.

On the other hand, on a propeller shaft for transmitting the engine torque to a propeller, a force acts counteracting the force of the propeller for propelling the ship forward. This reaction force acts in such a way as to move the engine relative to the hulls, so that the engine fixing means tends to loosen. Also, this force acts repeatedly on the engine as a thrust force. One way to damp this force is shown in FIGS. 6A, 6B.

The arrangement shown in FIG. 6A comprises a main engine unit 1 including an engine 2, a transmission 3 including a thrust bearing, a universal joint 3', another thrust bearing 3", a propeller shaft 4 and a propeller 5.

In the arrangement shown in FIG. 6B, the engine torque is transmitted through the transmission 3 to the propeller shaft 4, while the reaction force is dispersed by the thrust bearing 3".

With the arrangement that utilizes a rubber mount, it is possible to effectively damp vibrations transmitted from the engine to the hull while the ship speed is low. But as the ship speed increases to high speeds, it becomes difficult to damp engine vibrations. Thus, engine vibrations transmitted to the hull tend to grow to such an extent as to give unpleasant or unbearable feelings to people on board the ship.

This is because the rubber member loses its vibration damping functions at higher ship speeds. More specifically, as the ship speed increases to a certain point, the rubber member in the fixing means of the engine supporting rubber mount is pushed to one side due to the reaction force of the ship propelling force to such an extent that the fixing bolt abuts the fixing means. Once this happens, the rubber member cannot damp the horizontal component of the engine vibration any more.

One possible solution to this problem is to mount the thrust bearing shown in FIGS. 6A, 6B at an intermediate portion of the propeller shaft. But such a thrust bearing cannot reduce the displacement of the engine so dramatically. Moreover, this arrangement tends to be complicated in mechanism and thus costly.

SUMMARY OF THE INVENTION

An object of this invention is to provide a simple and effective method of damping vibrations of a hull of a small watercraft while the ship speed is low, intermediate and high.

According to this invention, there is provided a method of damping vibrations of the hull of a watercraft, in which an engine is secured to a bed of the hull through an elastic mounting means, and an engine movement restricting means is provided for preventing the engine from moving relative to the hull under a reaction force of the ship propelling force transmitted from a propeller means while the engine is being driven.

The elastic mounting means may comprise a fixing means including an elastic member for elastically supporting vertical and horizontal forces, and a mounting means for coupling the fixing means to legs of the engine. The engine movement restricting means may be a rod-shaped member having one end thereof fixed to the legs of the engine and the other end to a bed of the engine.

Preferably, at least one pair of the engine movement restricting means are provided on both sides of the engine in symmetrical relation with each other.

According to this invention, the engine of the ship is fixed to the bed through the elastic mounting means. As the engine speed increases from low to intermediate and high, its vibrations as well as the ship propelling force increase. As the latter increases, its reaction force increases, too. The reaction force tends to move the engine relative to the bed of the hull. But according to this invention, the engine is prevented from moving by the engine movement restricting means. Since the engine is prevented from moving relative to the bed, the elastic mounting means will never come into direct contact with the fixing metal of the bed, so that it is possible to effectively prevent the transmission of engine vibration to the hull. Namely, the elastic mounting means maintains the vibration damping function.

According to the present invention, the elastic mounting means is constructed from the fixing means including the elastic member, and the mounting means. The engine movement restricting means is a rod member provided between the legs of the engine and the engine bed. Such an arrangement is simple in structure and inexpensive.

According to the present invention, engine movement restricting means are provided on both sides of the engine. This arrangement is intended for use with a large-output engine.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT

Figure 1A:
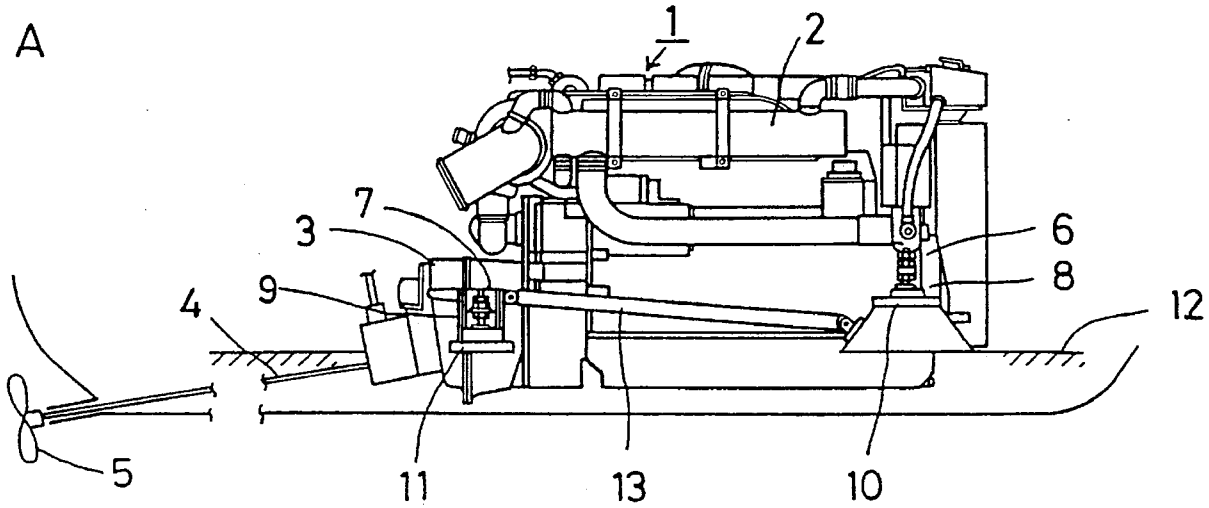
FIGS. 1A and 1B are general schematic views of an embodiment of the method according to the present invention.

FIG. 1 is a general schematic view of the hull vibration damping arrangement of one embodiment. The boat shown has a main engine unit 1 comprising an engine 2 and a transmission 3. A propeller shaft 4 carrying a propeller 5 is connected to and driven by the rotary shaft of the transmission 3. The main engine unit 1 is fixed to a bed 12 through legs 6 and 7 provided at both sides of the front and rear ends thereof. Though not shown in the figures, the legs 6, 7 on both sides are arranged symmetrically.

Figure 2A:
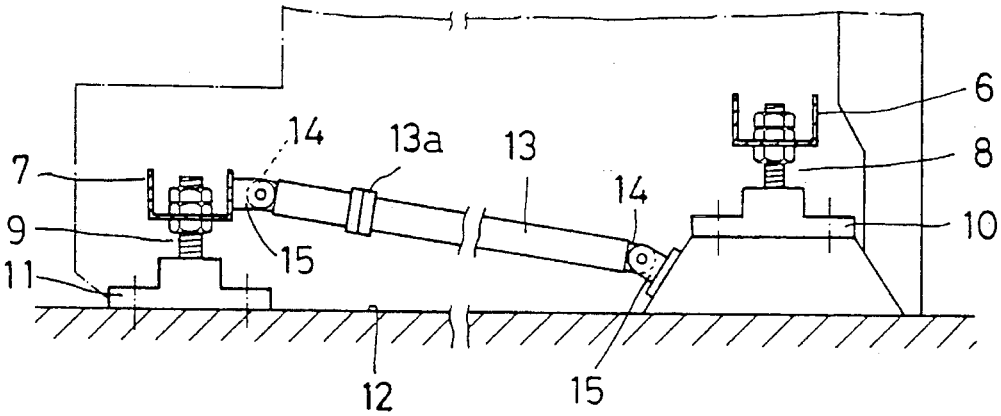
FIGS. 2A and 2B are detailed views of the same.
Figure 2B:
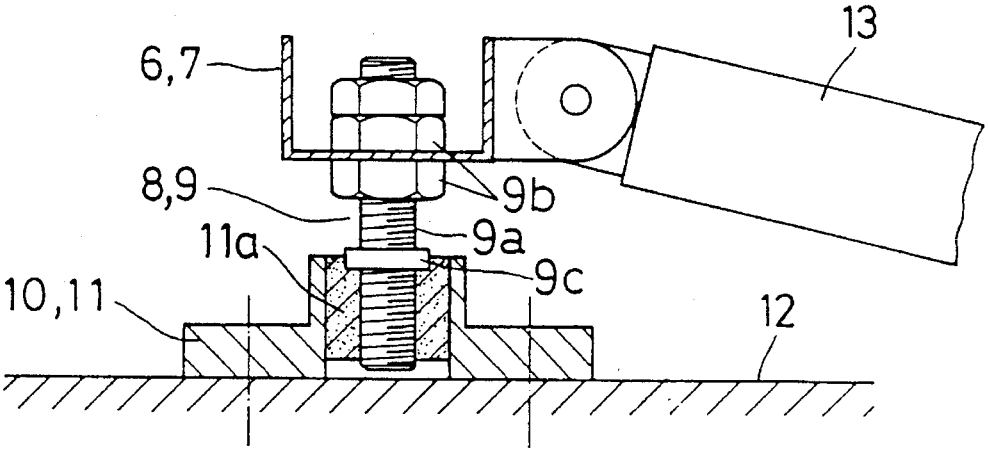

The legs 6 and 7 are fixed to the bed 12 by means of fixing means 10 and 11 including rubber mounting members 8 and 9, respectively. FIGS. 2A and 2B show the detailed structure of the fixing means. As shown in FIG. 2B, the mounting member 9 comprises a threaded bolt 9*a* inserted in a rubber elastic member 11*a* provided in the fixing means 11, and a nut 9*b* threaded onto the bolt, and a ring 9*c* also threaded onto the bolt. By tightening the nut 9*b*, the leg 7 is fixed to the bolt. The bolt 9*a* is resiliently supported by the rubber elastic member 11*a* through the ring 9*c*. The mounting members 8 are of exactly the same structure as the members 9.

Further, in this embodiment, a means 13 for preventing the engine from moving relative to the hull serves to prevent the engine vibration from being transmitted to the hull. This means 13 is a pipe support of a predetermined length carrying eyeplates 14 at both ends. One of the eyeplates 14 is connected to an eyeplate 15 provided on the legs 7 while the other is connected to an eyeplate 15 fixed to the bed to prevent the movement of the engine. The pipe support does not have to be a round pipe but may be a solid rod, a square pipe or a section steel.

Also, instead of providing the eyeplates 14, 15, the ends of the pipe support may be welded or otherwise directly fixed to the mating members. To allow fine adjustment of the length of the pipe support, an adjusting ring 13*a* may be provided at an intermediate portion of the pipe.

Figure 1B:
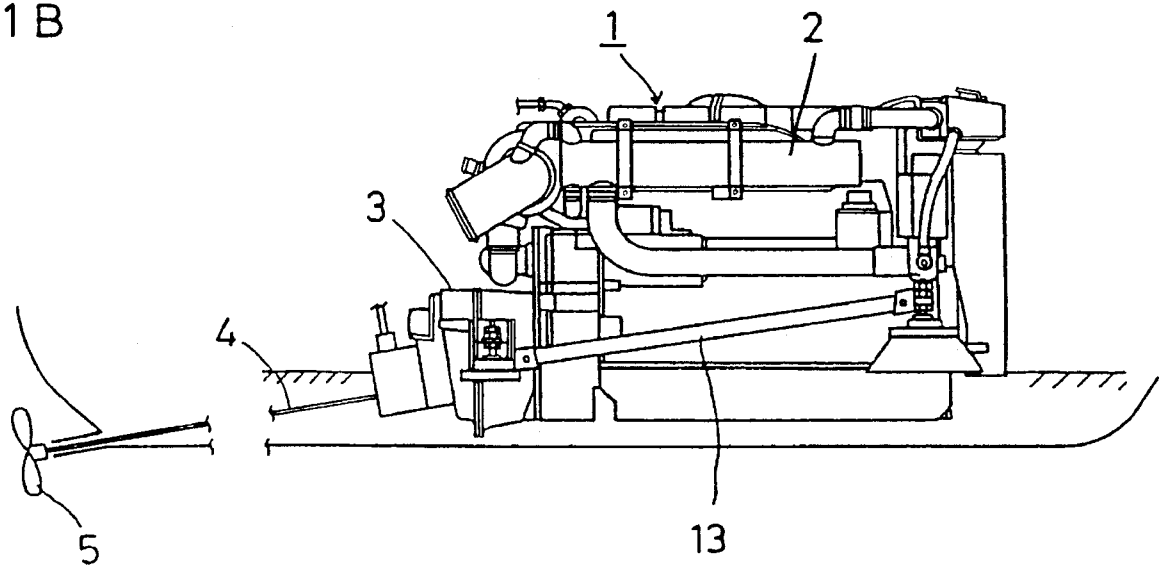
Figure 3:
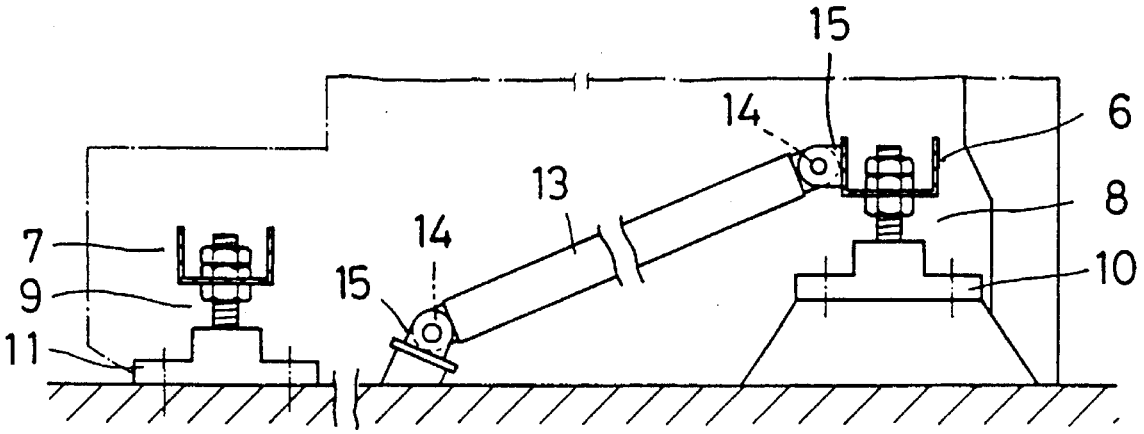
FIG. 3 is a detailed view of another embodiment.

In the arrangement of FIG. 1A, the pipe support as the engine movement restricting means 13 is arranged so that it is compressed. It may be arranged so as to be stretched as shown in FIG. 1B. FIG. 3 is a view of an arrangement in which the pipe is stretched, corresponding to FIG. 1B.

In the above embodiments, the mounting members 8, 9 are rubber members. But they may be such elastic members as steel leaf springs, coil springs, air cushions or FRP springs.

Figure 4A:
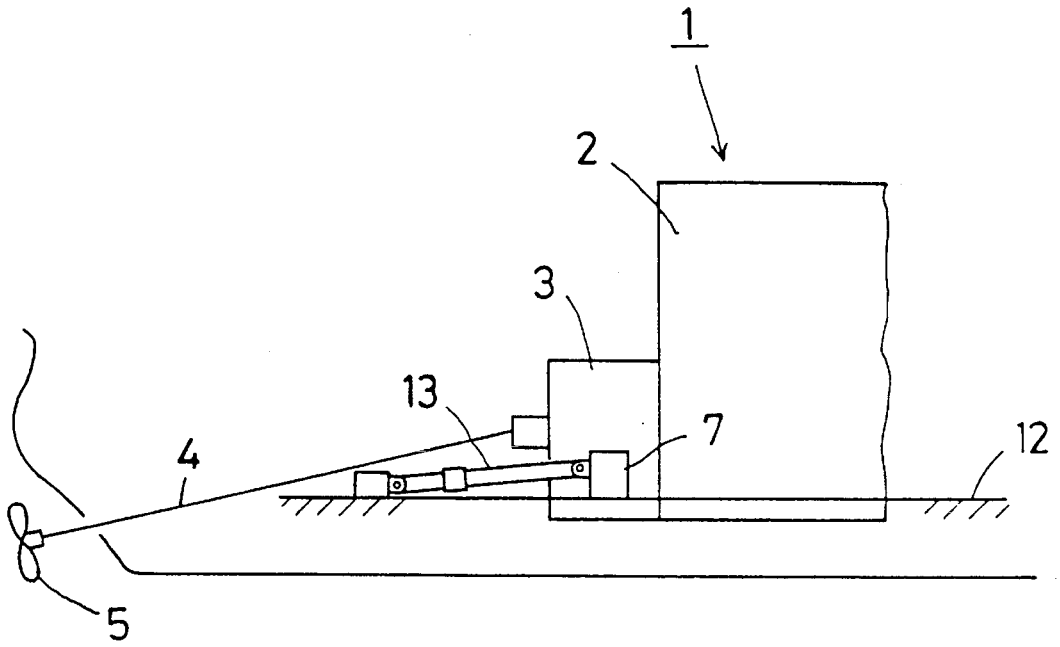
FIGS. 4A and 4B are detailed views of still another embodiment.
Figure 4B:
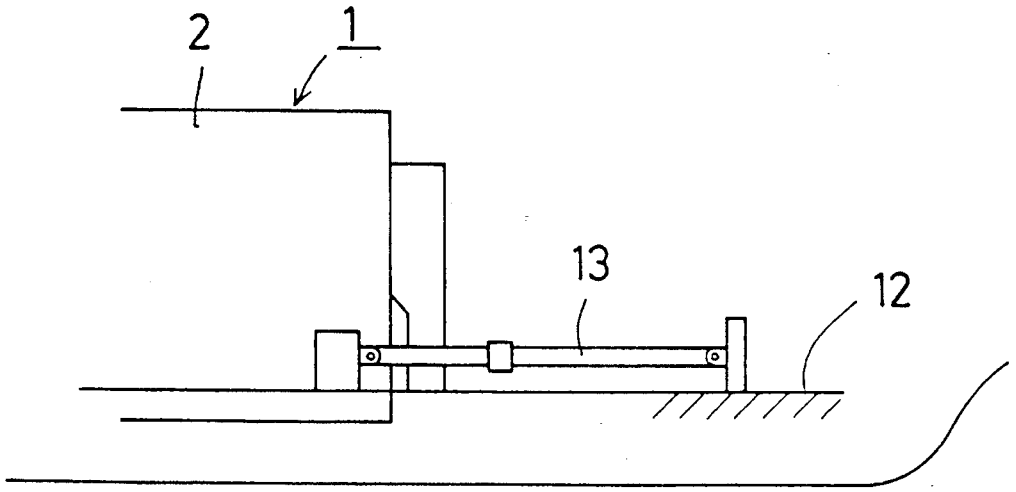

FIG. 4A shows an arrangement in which the engine movement restricting means 13 is provided behind the main engine unit 1, whereas in the arrangement shown in FIG. 4B, it may be arranged in front of the engine 1.

Figure 5A:
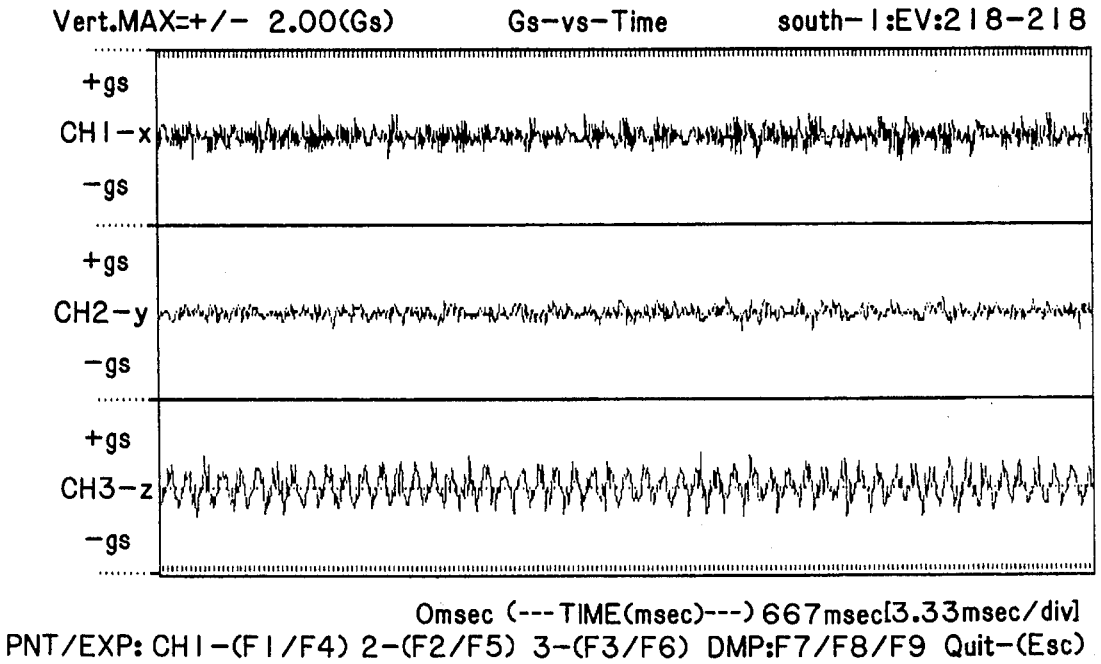
FIGS. 5A and 5B are graphs showing the vibration damping effect of the present invention.
Figure 5B:
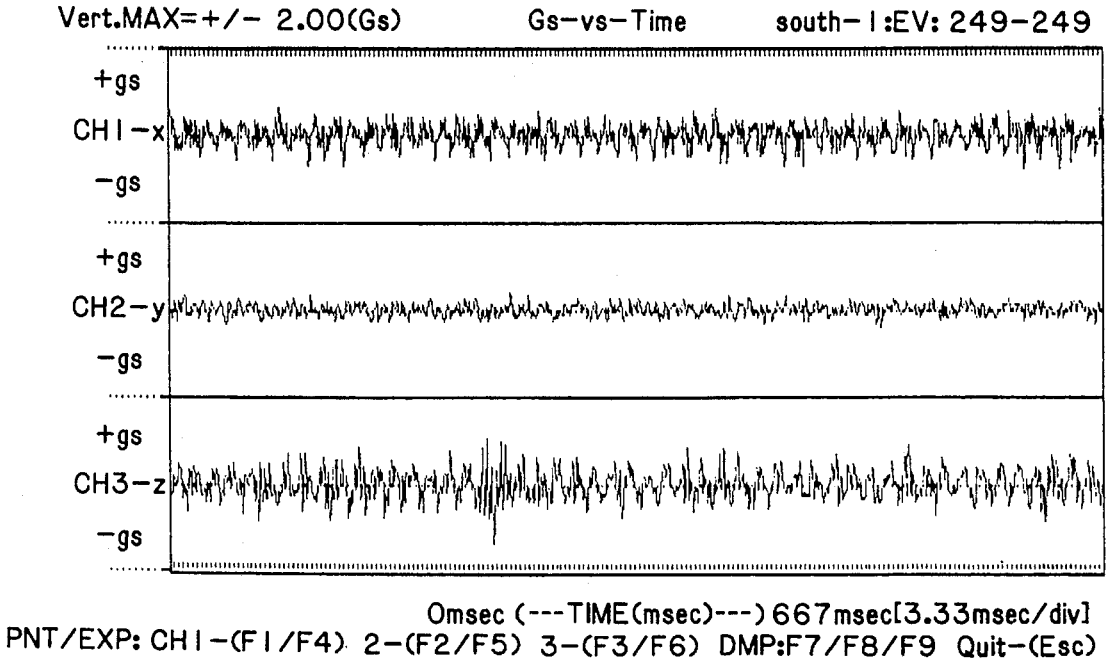
Figure 6A:
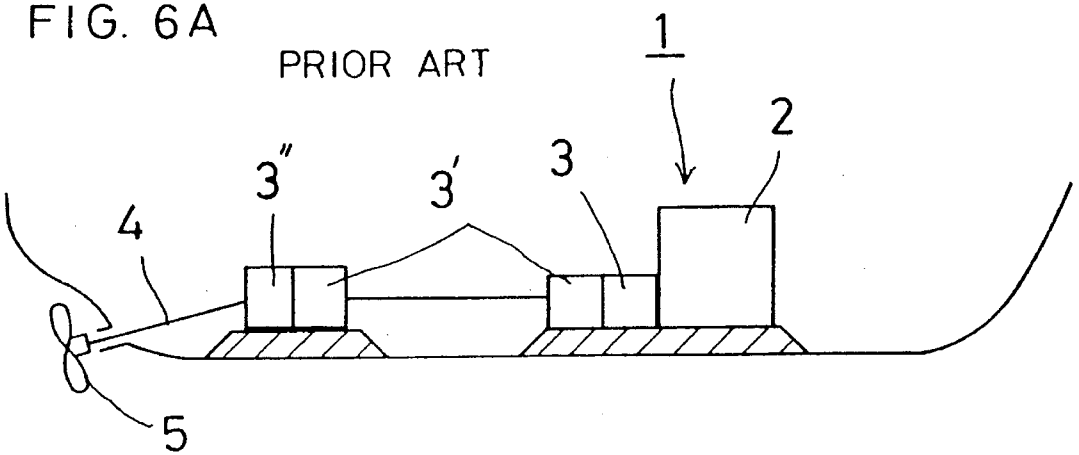
FIG. 6A PRIOR ART
FIGS. 6A and 6B are schematic views of a conventional ship propelling mechanism.
Figure 6B:
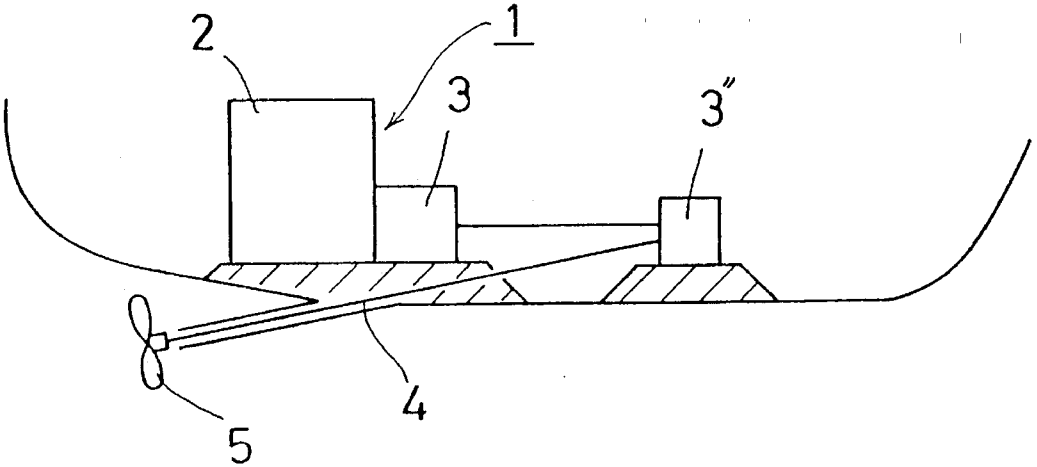
FIG. 6B PRIOR ART

FIGS. 5A and 5B show the results of measurements of vibration for a ship equipped with the vibration damping means according to the present invention and for a ship having no such means, respectively.

In the figures, X and Y indicate vibrations in horizontal directions while Z indicates vibrations in the vertical direction. From these figures, it will be apparent that the vibration damping means of the present invention can damp the vibrations particularly in the X and Z directions effectively.

What is claimed is:

1. A method of damping vibrations of the hull of a watercraft, comprising the steps of:

securing an engine to a bed of the hull by elastically mounting the engine to the bed with fixing members fixed relative to the bed, the fixing members comprising elastic members elastically supporting vertical and horizontal forces and mounting members coupling the fixing members to legs of the engine; and restricting horizontal movement of the engine under a force that is in reaction to a ship propelling force that is transmitted from a propeller to the engine while the engine is being driven by preventing the engine from moving relative to the hull, the engine being prevented from moving relative to the hull by a rod-shaped member that has one end thereof fixed to one of the legs of the engine and another end fixed to the bed.

2. The method of claim 1, wherein said step of restricting movement of the engine under a force that is in reaction to a ship propelling force that is transmitted from a propeller to the engine while the engine is being driven by preventing the engine from moving relative to the hull further comprises preventing the engine from moving relative to the hull with an additional rod-shaped member that has one end thereof fixed to one of the legs of the engine and another end fixed to the bed, the rod-shaped members being disposed on opposite sides of the engine in symmetrical relation to each other.

3. A device for damping vibrations of the hull of a watercraft that has an engine mounted on a bed of the hull, said device comprising:

an elastic mounting means for elastically mounting the engine to the bed, said elastic mounting means comprising a fixing means for fixing the engine relative to the bed and an elastic member connected with said fixing means for elastically supporting vertical and horizontal forces that are applied to the engine;

a mounting means for mounting and coupling said fixing means to a leg of the engine; and an engine movement restricting means for restricting the engine from moving horizontally relative to the hull under a force that is in reaction to a ship propelling force that is transmitted from a propeller to the engine while the engine is being driven, said engine movement restricting means comprising a first end fixed to the leg of the engine and a second end fixed to the bed of the engine.

4. A device for damping vibrations of the hull of a watercraft that has an engine mounted on a bed of the hull, the engine having a propeller shaft connected therewith and legs for supporting the engine, and said device comprising:

a plurality of elastic mounting devices, each of said elastic mounting devices comprising a fixing member fixed relative to the bed of the hull and an elastic member supported by said fixing member;

a plurality of mounting members engaged with said elastic members so as to couple the legs of the engine to said fixing members through said elastic members; and at least one engine movement restricting device comprising a rigid member extending substantially horizontally in the direction of the propeller shaft and having one end fixed to one of the legs of the engine and another end fixed relative to the bed supporting the engine.

5. The device of claim 4, wherein said at least one engine movement restricting device comprises a rod connected to one of the legs of the engine and to the bed.

6. The device of claim 5, wherein said rod is connected with one of the legs of the engine and the bed of the hull by eyeplates.

7. The device of claim 4, wherein said at least one engine movement restricting device comprises a rod connected between one of the legs of the engine and the bed of the hull.

8. The device of claim 4, wherein said at least one engine movement restricting device comprises a pair of engine movement restricting devices each connected between separate ones of the legs of the engine and the bed.

* * * * *